US008098223B2

(12) United States Patent
Yun et al.

(10) Patent No.: US 8,098,223 B2
(45) Date of Patent: Jan. 17, 2012

(54) APPARATUS AND METHOD FOR DRIVING A LIQUID CRYSTAL DISPLAY DEVICE TO PREVENT DEFECTIVE IMAGES DURING FREQUENCY CONVERSION

(75) Inventors: Sang Chang Yun, Gyeongsangbuk-do (KR); Jae Sung Kim, Daegu-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 12/952,557

(22) Filed: Nov. 23, 2010

(65) Prior Publication Data

US 2011/0063271 A1 Mar. 17, 2011

Related U.S. Application Data

(62) Division of application No. 11/598,721, filed on Nov. 14, 2006, now Pat. No. 7,864,153.

(30) Foreign Application Priority Data

Mar. 30, 2006 (KR) ..... P 2006-0028981
Aug. 28, 2006 (KR) ..... P 2006-0081519

(51) Int. Cl.
*G09G 3/36* (2006.01)

(52) U.S. Cl. ..... 345/99

(58) Field of Classification Search ..... 345/99, 345/208, 213; 348/792, 790
See application file for complete search history.

(56) References Cited

U.S. PATENT DOCUMENTS 5,321,750 A 6/1994 Nadan ..... 380/230
6,052,103 A * 4/2000 Fujiwara et al. ..... 345/89
6,177,922 B1 1/2001 Schiefer et al. ..... 345/698
7,796,198 B2 * 9/2010 Ikeda et al. ..... 348/790
7,812,833 B2 * 10/2010 Kim et al. ..... 345/99
2002/0075255 A1 6/2002 Baek et al. ..... 345/212
2004/0017345 A1 * 1/2004 Lee ..... 345/87
2004/0150605 A1 8/2004 Arimoto et al. ..... 345/100
2005/0271176 A1 12/2005 Harada et al. ..... 75/358
2006/0139359 A1 6/2006 Naito et al. ..... 345/530
2009/0096769 A1 * 4/2009 Kim et al. ..... 345/204

FOREIGN PATENT DOCUMENTS

JP 11-296128 10/1999
JP 2002-108308 4/2002
JP 2002-149118 5/2002
JP 2002-202772 7/2002
JP 2002-366127 12/2002
JP 2003-162267 6/2003
JP 2004-151222 5/2004
JP 2005-031316 2/2005
JP 2006-011467 1/2006
WO 2005/045795 A1 5/2005

* cited by examiner

*Primary Examiner* — Chanh Nguyen
*Assistant Examiner* — Allison Walthall
(74) *Attorney, Agent, or Firm* — Morgan, Lewis & Bockius LLP

(57) ABSTRACT

An apparatus and method for driving a liquid crystal display (LCD) device is disclosed, to prevent error of a timing controller and to prevent the defective image on a frequency conversion, the apparatus comprising a liquid crystal display part to display images, a driver to drive the liquid crystal display part, a graphic system to output frequency-conversion prediction information in accordance with a frequency-conversion signal, and perform frequency conversion of a plurality of synchronizing signals, and a timing controller to control the driver to display video data according to a previous frame during the frequency conversion, in response to the frequency-conversion prediction information.

5 Claims, 8 Drawing Sheets

APPARATUS AND METHOD FOR DRIVING A LIQUID CRYSTAL DISPLAY DEVICE TO PREVENT DEFECTIVE IMAGES DURING FREQUENCY CONVERSION

This application is a divisional application of application Ser. No. 11/598,721, filed on Nov. 14, 2006 now U.S. Pat. No. 7,864,153, which claims the benefit of Korean Patent Application Nos. P2006-028981, filed on Mar. 30, 2006, and P2006-081519, filed on Aug. 28, 2006, which are hereby incorporated by reference.

BACKGROUND OF THE INVENTION

1. Field of the Invention

The present invention relates to an apparatus and method for driving a liquid crystal display (LCD) device to prevent error of a timing controller when performing frequency conversion, thereby preventing display of defective images.

2. Discussion of the Related Art

Generally, a liquid crystal display (LCD) device can display various images by controlling light transmittance using driving circuits. The LCD device includes a liquid crystal display part that displays the images and a driving circuit that controls the liquid crystal display part. In particular, the liquid crystal display part includes a plurality of sub pixels that form pixel matrices, a plurality of thin film transistors that respectively drive the sub pixels, a plurality of gate lines that respectively control the thin film transistors, and a plurality of data lines that respectively supply data to the thin film transistors. The driving circuit includes a gate driver that drives the gate lines of the liquid crystal display part, a data driver that drives the data lines of the liquid crystal display part, and a timing controller that controls the gate driver and the data driver. The timing controller aligns video data input from the exterior, and supplies the aligned video data to the data driver. Also, the timing controller controls the timing of the gate driver and the data driver by using a plurality of synchronizing signals input from the exterior.

In the related art LCD device, a screen where the image is to be displayed may display a defective image during the process of converting driving frequencies for low power consumption. For example, if a frame frequency of 60 Hz is converted to a frame frequency of 50 Hz, the plurality of synchronizing signals are also modulated and supplied to the timing controller at a frequency that is appropriate for the frame frequency of 50 Hz. The timing controller controls the gate driver and the data driver with the synchronizing signals according to this modulated frequency. Therefore, the liquid crystal display part can display an image with a frame frequency of 50 Hz. However, when converting the frame frequency, the synchronizing signals are unstable and therefore may cause error of the timing controller. Thus, it results in display of defective images, examples of which include the unstable image being displayed in the liquid crystal display part, or a message of "no signal" being displayed in the liquid crystal display part.

SUMMARY OF THE INVENTION

Accordingly, the present invention is directed to an apparatus and method for driving liquid crystal display device that substantially obviates one or more problems due to limitations and disadvantages of the related art.

An object of the present invention is to provide an apparatus and method for driving an LCD device to prevent error of a timing controller on a frequency conversion, thereby preventing display of a defective image.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an apparatus driving liquid crystal display device includes a liquid crystal display part to display images, a driver to drive the liquid crystal display part, a graphic system to output frequency-conversion prediction information in accordance with a frequency-conversion signal, and perform frequency conversion of a plurality of synchronizing signals, and a timing controller to control the driver to display video data according to a previous frame during the frequency conversion, in response to the frequency-conversion prediction information.

In another aspect, an apparatus for driving an LCD device includes a liquid crystal display part to display images, a driver to drive the liquid crystal display part, a graphic system to output video data and a plurality of synchronizing signals, output frequency-conversion prediction information in accordance with a frequency-conversion signal, and perform frequency conversion of the plurality of synchronizing signals, and a timing controller to control the driver by using a video data and the synchronizing signals, prepare predetermined video data in response to the frequency-conversion prediction information, and control the driver to display predetermined video data on the liquid crystal display part during the frequency conversion.

In another aspect, an apparatus for driving an LCD device includes a liquid crystal display part to display images, a driver to drive the liquid crystal display part, a graphic system to output video data and a plurality of synchronizing signals, output frequency-conversion prediction information in accordance with a frequency-conversion signal, and output frequency converted synchronizing signals, and a timing controller to control the driver by using the video data and synchronizing signals and to prevent the driver from being driven for a period of converting the frequency in response to the frequency-conversion prediction information.

In another aspect, a method for driving an LCD device includes generating a frequency-conversion signal, generating frequency-conversion prediction information in response to the frequency-conversion signal, converting frequency of the synchronizing signals in response to the frequency-conversion signal, and displaying the video data of a previous frame in response to the frequency-conversion prediction information during the converting step.

In another aspect, a method for driving an LCD device includes generating a frequency-conversion signal, generating frequency-conversion prediction information in response to the frequency-conversion signal, preparing predetermined video data in response to the frequency-conversion prediction information, converting frequency of the synchronizing signals in response to the frequency-conversion signal, generating a plurality of control signals by using an internal clock during the converting step, and displaying the predetermined video data by using the plurality of control signals during the converting step.

In another aspect, a method for driving an LCD device includes generating a frequency-conversion signal, generating frequency-conversion prediction information in response to the frequency-conversion signal, converting frequency of the synchronizing signals in response to the frequency-conversion signal, detecting a frequency-conversion period in response to the frequency-conversion prediction information, and blocking the input of at least one synchronizing signal used for generating the plurality of control signals in the frequency-conversion period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
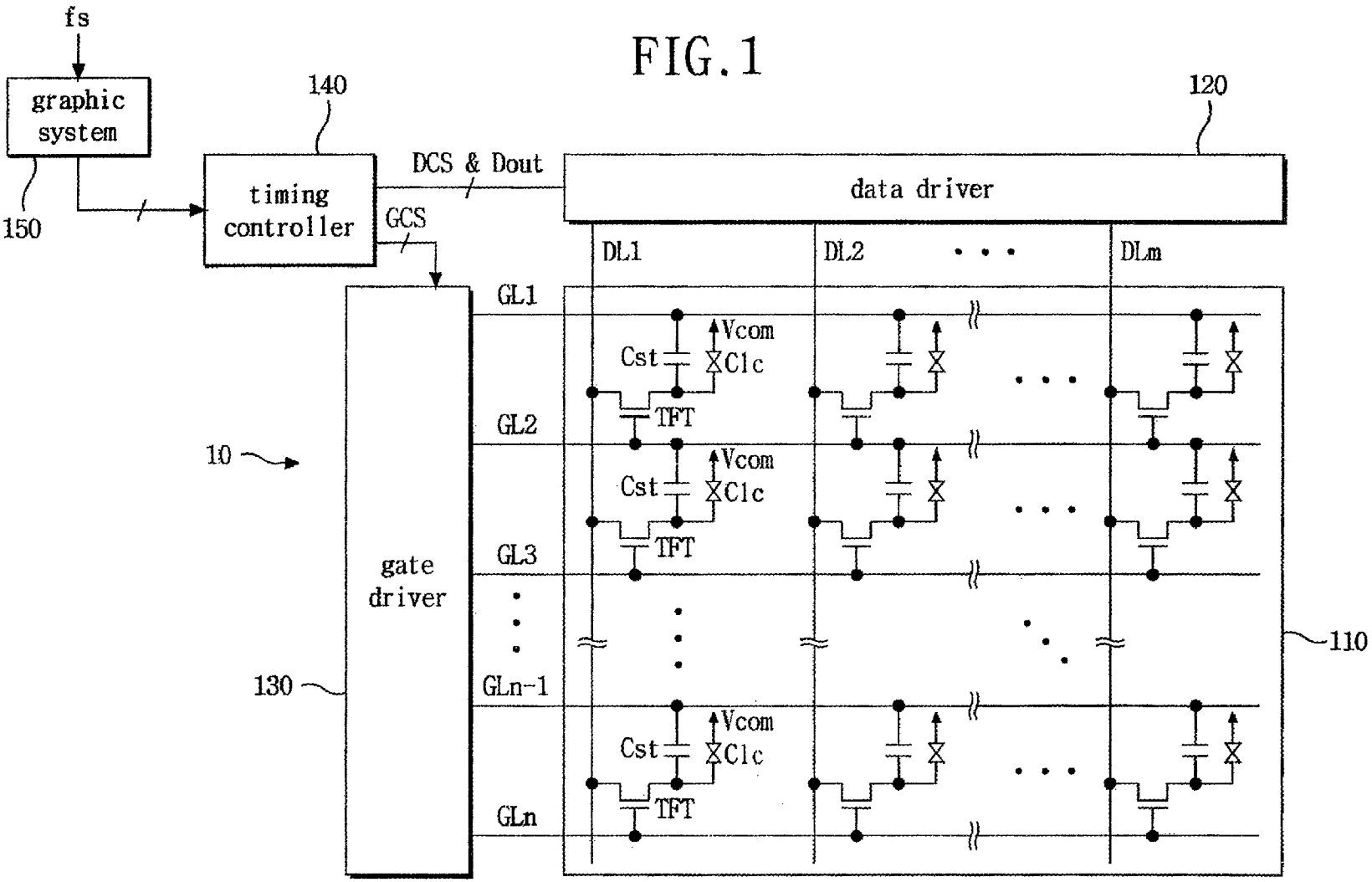
FIG. 1 illustrates an exemplary apparatus for driving an LCD device according to the present invention.

FIG. 1 illustrates an exemplary apparatus for driving an LCD device according to the present invention. As shown in FIG. 1, the apparatus according to the present invention includes an LCD unit 10 and a graphic system 150 provided inside a computer system for controlling the LCD unit 10. The LCD unit 10 includes a liquid crystal display part 110 that displays images, a data driver 120 that drives data lines (DL1 to DLm) of the liquid crystal display part 110, a gate driver 130 that drives gate lines (GL1 to GLn) of the liquid crystal display part 110, and a timing controller 140 that is connected with the graphic system 150 and controls the data driver 120 and the gate driver 130.

The graphic system 150 supplies a plurality of synchronizing signals and video data, appropriate for the resolution of the LCD unit 10, to the timing controller 140. The synchronizing signals control the driving timing of the LCD unit 10. In other words, the synchronizing signals include a dot clock signal (DCLK) that determines a video data transmission speed; a data enable signal (DE) that provides information relating an effective period of the video data; a horizontally synchronized signal (Hsync) that provides information relating one horizontally synchronized period; and a vertically synchronized signal (Vsync) that provides information relating one vertically synchronized period. The synchronizing signals are supplied to the timing controller 140.

In the meantime, the graphic system 150 may generate only a dot clock signal (DCLK) and a data enable signal (DE), and provide them to the timing controller 140 since the data enable signal (DE) includes the timing information of the horizontally and vertically synchronized signals (Hsync, Vsync). To decrease electromagnetic interference (EMI), the graphic system 150 compresses the video data (RGB) and synchronizing signals into serial data (SD), and supplies the serial data (SD) to the timing controller 140. However, the dot clock signal (DCLK) is separately supplied to the timing controller 140 without being compressed.

If a frequency conversion signal (fs) is input to the graphic system 150 from the exterior, the frequencies of the synchronizing signals are converted and supplied to the timing controller 140. In particular, the graphic system 150 generates an option data or a control signal that can predict the conversion of frequency before the frequency of the synchronizing signals is converted in response to the frequency conversion signal (fs). Then the graphic system 150 supplies the generated option data or control signal to the timing controller 140. In other words, the graphic system 150 generates frequency-conversion prediction information before the frequencies of the synchronizing signals are converted, and supplies the frequency-conversion prediction information to the timing controller 140. Accordingly, the timing controller 140 can prepare the following operation in accordance with the conversion of the frequency without any problem or error. If a user commands a frequency conversion or a display of a predetermined image on a stop or stand-by mode to decrease the power consumption, the frequency conversion signal (fs) is generated in the computer system, and is supplied to the graphic system 150.

The timing controller 140 restores the serial data (SD) to the video data and synchronizing signals in accordance with the dot clock signal (DCLK) supplied from the graphic system 150. Also, the timing controller 140 aligns (i.e., orders) and supplies the aligned video data to the data driver 120. The timing controller 140 generates data and gate control signals (DCS, GCS) by using the synchronizing signals, and supplies the respective data and gate control signals (DCS, GCS) to the data and gate drivers 120 and 130.

Furthermore, if the frequency-conversion prediction information, for example, the control signal or option data, is input to the timing controller 140 from the graphic system 150, the video data of a final frame, output from the graphic system 150, is stored in a frame memory of the timing controller 140. At this time, the final frame indicates a frame immediately before the frame frequency is converted. For example, when the first frame frequency is converted into the second frame frequency in the graphic system 150, the final frame indicates the frame driven by the first frame frequency.

Meanwhile, if the video data output from the graphic system 150 is buffered and used in the frame memory of the timing controller 140, the timing controller 140 responds to the frequency-conversion prediction information, whereby the video data next to the final frame is not stored. On conversion of the frequency in the graphic system 150, the final frame stored in the frame memory for an unstable period of the synchronizing signal, i.e., the video data of the previous frame is supplied to the data driver 120. At this time, the gate control signal (GCS) and data control signal (DCS) are generated using an internal clock output from an oscillator (OSC) of the timing controller 140 instead of the unstable synchronizing signal output from the graphic system 150. Then, the timing controller 140 controls the gate drivers 130 and data drivers 120 with the generated control signals (GCS, DCS) so as to continuously display the image of the previous frame during the process of frequency conversion.

In the meantime, the timing controller 140 stops the generation of the gate and data controls signals (GCS, DCS) during the process of converting the frequency, and does not drive the gate and data drivers 130 and 120. Thus, the charged image of the previous frame is continuously maintained in the liquid crystal display part 110. For this purpose, the timing controller 140 prevents the dot clock signal (DCLK) from being input to a block of generating the control signals (GCS, DCS) during the unstable period of the synchronizing signal, which is after the frequency-conversion prediction information is input.

If the stable synchronizing signal is input along with the completion of frequency conversion in the graphic system 150, the timing controller 140 generates the data control signal (DCS) and the gate control signal (GCS) by using the synchronizing signal with the converted frequency. Accordingly, the data and gate drivers 120 and 130 are controlled with the data and gate control signals (DCS, GCS) having the converted frequency. In other words, the liquid crystal display part 110 is driven by the converted frame frequency, to thereby display the image.

The gate driver 130 generates scan pulses in response to the gate control signal (GCS) output from the timing controller 140, to thereby drive the gate lines (GL1 to GLn) of the liquid crystal display part 100 in sequence. The data driver 120 latches the video data output from the timing controller 140 in response to the data control signal (DCS) output from the timing controller 140. Then, the latched video data is converted into analog video data signals. The analog video data signals are supplied to the data lines (DL1 to DLm) of the liquid crystal display part 110. In other words, the data driver 120 selects a gamma voltage corresponding to a gray level of the video data and supplies the selected gamma voltage to the data lines (DL1 to DLm). Also, the data driver 120 supplies the data lines (DL1 to DLm) with the video data signals corresponding to one horizontal line per one horizontal period in which the scan pulses are supplied into the gate lines (GL1 to GLn).

The liquid crystal display part 110 includes 'n' gate lines (GL1 to GLn), 'm' data lines (DL1 to DLm), a plurality of thin film transistors (TFTs) formed in respective pixel regions defined by the gate and data lines, and pixel electrodes being respectively connected with the thin film transistors (TFTs) so as to drive liquid crystal molecules. The thin film transistor (TFT) supplies the data signal output from the data line (DL) to the pixel electrode in response to the scan pulse output from the gate line (GL). The pixel electrode and a common electrode (Vcom) form a liquid crystal capacitor (Clc) so as to drive liquid crystal. Also, the pixel electrode overlaps with the previous gate line, to thereby form a storage capacitor (Cst). Here, the pixel electrode may overlap with an additional common line to form the storage capacitor (Cst). Both the liquid crystal capacitor (Clc) and the storage capacitor (Cst) maintain the data signal applied to the pixel electrode until the next data signal is charged.

Figure 2:
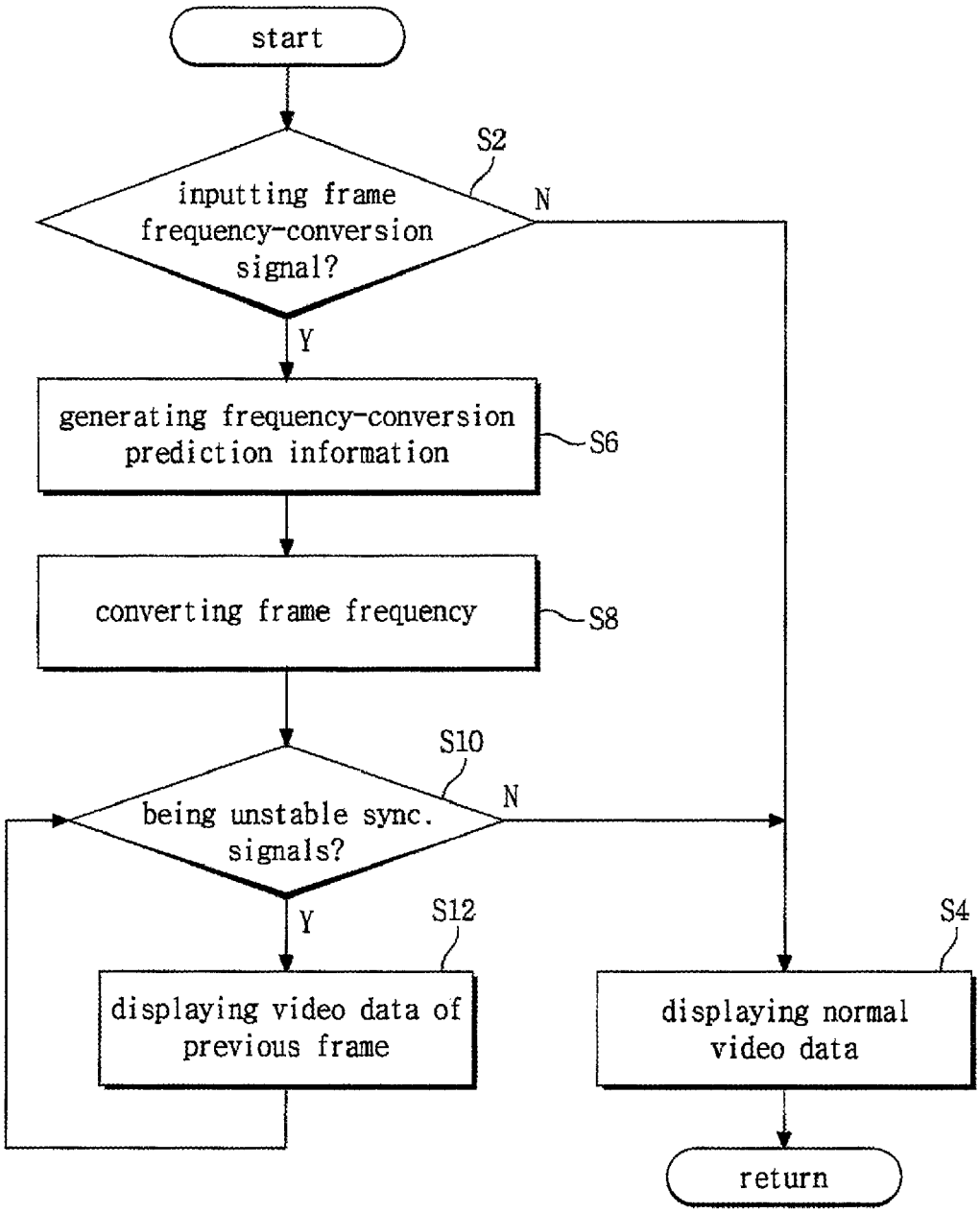
FIG. 2 illustrates a flow chart of showing an exemplary method for driving the LCD device according to the present invention.

FIG. 2 illustrates a flow chart of showing an exemplary method for driving the LCD device according to the present invention, which is explained with reference to the LCD device shown in FIG. 1. If the frequency-conversion signal fs is not input in step 2 (S2), the graphic system 150 proceeds to step 4 (S4) so that the normal video data and synchronized signals are supplied to the timing controller 140, whereby the liquid crystal display part 110 displays the normal image.

Meanwhile, if the frequency-conversion signal fs is externally input in step 2 (S2), the graphic system 150 proceeds to step 6 (S6) so that the frequency-conversion prediction data is generated in the form of control signals or option data, and is further supplied to the timing controller 140. In step 6 (S6), in response to the frequency-conversion prediction information, the timing controller 140 may store the frame memory with the video data of the corresponding frame before the frame frequency is converted in the graphic system 150, or the timing controller 140 may rather maintain the video data stored in the previous frame.

In step 8 (S8), the graphic system 150 responds to the frequency-conversion signal fs so that the frequency of synchronized signals is converted to be suitable for the selected frame frequency, and is further supplied to the timing controller 140.

In step 10 (S10), the timing controller 140 detects the unstable period of at least one synchronized signal, which is caused by the frequency-conversion operation of the graphic system 150, in response to the frequency-conversion prediction information. At this time, before detecting the unstable period of the synchronized signal, step 4 (S4) proceeds so that the timing controller 140 outputs the normal video data supplied from the graphic system 150, thereby displaying the normal image on the liquid crystal display part 110.

If the unstable period of the synchronized signal caused by the frequency-conversion operation of the graphic system 150 is detected in step 10 (S10), the system proceeds to step 12 (S12) so that the timing controller 140 outputs the video data of the previous frame stored in the frame memory, thereby displaying the image of the previous frame on the liquid crystal display part 110. On the other hand, if the unstable period of the synchronized signal is detected, the timing controller 140 stops generating the gate control signal GCS and the data control signal DCS supplied to the gate driver 130 and the data driver 120. In this case, the liquid crystal display part 110 is maintained and displayed with the charged image of the previous frame since the timing controller 140 does not output either the gate control signal GCS and the data control signal DCS. If the synchronized signal is stabilized in step 10 (S10) after the completion of the frequency conversion, the system proceeds to step 4 (S4) so that the timing controller 140 outputs the normal data supplied from the graphic system 150, thereby displaying the normal image on the liquid crystal display part 110.

In the apparatus and method for driving the LCD device according to the present invention, the graphic system 150 operates the liquid crystal display part 110 in response to the frequency-conversion prediction information, using an internal clock and the video data according to the previous frame during the frame frequency conversion, so that it is possible to prevent any error in the timing controller 140 and any degradation in the quality of the picture. Also, in the apparatus for driving the LCD device, the liquid crystal display part 110 is maintained with the image of the previous frame without driving the gate driver 130 and the data driver 120 on the frame frequency conversion, thereby preventing the defective image.

Figure 3:
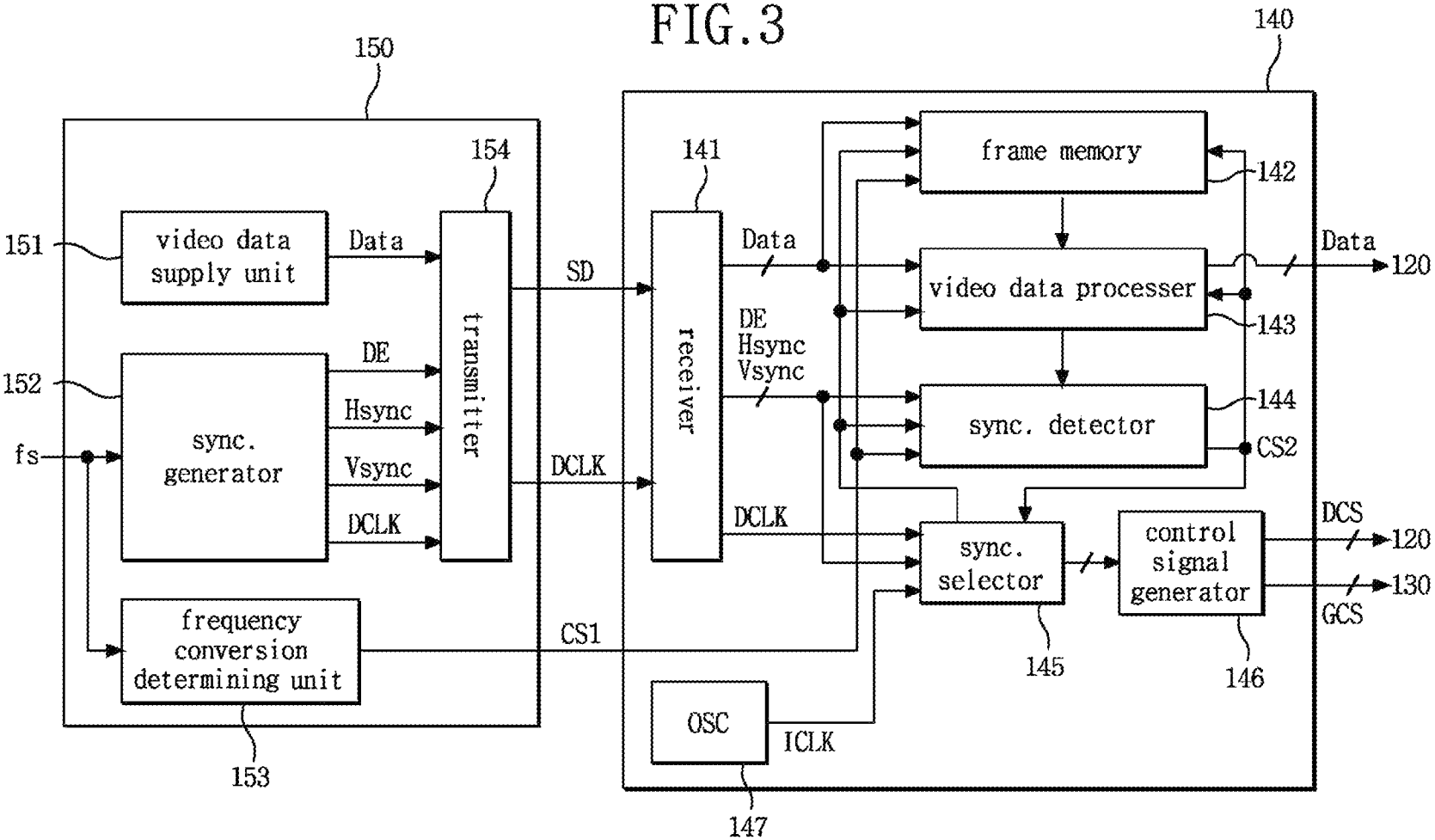
FIG. 3 illustrates a graphic system and a timing controller according to the first exemplary embodiment of the present invention.

FIG. 3 illustrates a graphic system and a timing controller according to the first exemplary embodiment of the present invention. As shown in FIG. 3, the graphic system according to the first exemplary embodiment of the present invention includes a video data supplying unit 151, a synchronizing signal generating unit 152, a frequency conversion determining unit 153, and a data transmitting unit 154. In this case, extended display identification data (EDID) output from the computer system or the LCD unit 10 is stored in an internal memory (not shown) of the graphic system 150. The EDID includes information relating resolution, data format, and the frame frequency of the LCD unit 10.

The video data supplying unit 151 aligns the video data input from the exterior and supplies the aligned video data to the data transmitting unit 154. The synchronizing signal generating unit 152 generates a plurality of synchronizing signals (DCLK, Hsync, Vsync, DE) in accordance with the EDID, and supplies the generated synchronizing signals to the data transmitting unit 154. When the frequency conversion signal (fs) is input externally, the synchronizing signal generating unit 152 selects the frame frequency to be converted in the EDID, converts the frequency of the synchronizing signals to be appropriate for the selected frame frequency, and supplies the synchronizing signals having the converted frequency to the data transmitting unit 154.

The data transmitting unit 154 compresses the video data output from the video data supplying unit 151 and the synchronizing signals (Hsync, Vsync, DE) output from the synchronizing signal generating unit 152 into the serial data (SD). The data transmitting unit 154 then supplies the compressed data to the timing controller 140 and supplies the non-compressed dot click signal (DCLK). For example, the data transmitting unit 154 compresses the video data and synchronizing signals (Hsync, Vsync, DE) into the serial data such as a low voltage differential signal (LVDS) and a transition minimized differential signal (TMDS), and supplies the serial data (SD). The frequency conversion determining unit 153 generates a first selection signal (CS1) related with frequency prediction information in response to the frequency conversion signal (fs), and supplies the generated first selection signal (CS1) to the timing controller 140.

As shown in FIG. 3, the timing controller 140 includes a data receiving unit 141, a frame memory 142, a video data processing unit 143, a synchronizing signal detecting unit 144, a synchronizing signal selecting unit 145, a control signal generating unit 146, and an oscillator (hereinafter referred to as 'OSC') 147.

The data receiving unit 141 restores the serial data (SD), received with the dot clock signal (DCLK) from the graphic system 150, to the video data and synchronizing signals (DE, Hsync, Vsync), and then outputs the video data and synchronizing signals in parallel. Also, the data receiving unit 141 outputs the dot clock signal (DCLK) without being restored.

The synchronizing signal detecting unit 144 detects the unstable period of the synchronizing signal, generated during the process of converting the frame frequency in the graphic system 150, i.e., the period where the frame frequency is converted. In particular, if the first selection signal (CS1) output from the graphic system 150 is input, the synchronizing signal detecting unit 144 examines at least one of the synchronizing signals (DE, Hsync, Vsync, DCLK) so as to detect the unstable period thereof. For example, if the first selection signal (CS1) is input, the synchronizing signal detecting unit 144 detects the unstable period of the data enable signal (DE) and generates a second selection signal (CS2) for indicating the detected unstable period. At this time, the synchronizing signal detecting unit 144 counts the number of data enable signals (DE) by using the dot clock signal (DCLK) or the internal clock signal (ICLK). If the counted number is outside the reference range, it is referred to as the unstable period, thereby generating the second selection signal (CS2).

Based on the second selection signal (CS2) output from the synchronizing signal detecting unit 144, the synchronizing signal selecting unit 145 supplies the synchronizing signals (DC, Hsync, Vsync, DCLK) output from the data receiving unit 141 or the internal clock signal (ICLK) output from the OSC 147. In the disable period of the second selection signal (CS2), the synchronizing signal selecting unit 145 supplies the synchronizing signals (DE, Hsync, Vsync, DCLK) output from the data receiving unit 141 to the control signal generating unit 146. At this time, the disable period of the second selection signal (CS2) means a period which has no conversion of frame frequency in the graphic system 150, or which has the stable synchronizing signals (DE, Hsync, Vsync, DCLK) supplied after completing the conversion of frame frequency. In the enable period of the second selection signal (CS2), where the synchronizing signal is in the unstable period during the process of converting the frequency, the synchronizing signal selecting unit 145 supplies the internal clock (ICLK) output from the OSC 147 to the control signal generating unit 146. The dot clock signal (DCLK) or the internal clock signal (ICLK) selected by the synchronizing signal selecting unit 145 supplies the frame memory 142, the video data processing unit 143, and the synchronizing signal detecting unit 144.

The control signal generating unit 146 generates the data control signal (DCS) and the gate control signal (GCS) by using the synchronizing signals (DC, Hsync, Vsync, DCLK) or the internal clock (ICLK) output from the synchronizing signal selecting unit 145, and respectively supplies the generated data and gate control signals (DCS, GCS) to the data drivers 120 and the gate drivers 130. In particular, the control signal generating unit 146 generates the data and gate control signals (DCS, GCS) using the synchronizing signals (DE, Hsync, Vsync, DCLK) output from the synchronizing signal selecting unit 145 in the stable period of the synchronizing signal. In the unstable period of the synchronizing signal, the data and gate control signals (DCS, GCS) are generated by using the internal clock (ICLK) output from the synchronizing signal selecting unit 145. At this time, if the internal clock signal (ICLK) is input, the control signal generating unit 146 generates the data enable signal (DE) by using the stored information and the internal clock signal (ICLK), and generates the horizontally and vertically synchronized signals (Hsync, Vsync) by using the data enable signal (DE) and the internal clock signal (ICLK). Then, the data control signal (DCS) and the gate control signal (GCS) are generated using the generated synchronizing signals (DE, Hsync, Vsync) and the internal clock signal (ICLK). At this time, the control signal generating unit 146 generate the data control signal (DCS) and the gate control signal (GCS) using the data enable signal (DE) and the internal clock signal (ICLK).

When the first selection signal (CS1) output from the graphic system 150 is input, the frame memory 142 stores the video data of the final frame from the data receiving unit 141. Then, the video data of the final frame stored in the enable period of the second selection signal (CS2) output from the synchronizing signal detecting unit 144, i.e., the video data of the previous frame, is supplied to the video data processing unit 143.

In the meantime, the frame memory 142 buffers the video data output from the data receiving unit 141 by frames, and supplies the video data buffered by frames to the video data processing unit 143. In this case, when the first selection signal (CS1) is input, the frame memory 142 maintains the video data of the final frame without being updated. Also, the video data of the final frame (previous frame) stored in the frame memory 142 for the enable period of the second selection signal (CS2) is supplied to the video data processing unit 143. Subsequently, when the second selection signal (CS2) is disabled after the conversion of frequency is completed, the frame memory 142 buffers the video data output from the data receiving unit 141, and supplies the buffered video data to the data processing unit 143. The frame memory 142 uses the dot clock signal (DCLK) or the internal clock signal (ICLK) from the synchronizing signal selecting unit 145 so as to input or output the video data.

The video data processing unit 143 aligns the video data output from the data receiving unit 141 or the frame memory 142 to be appropriate for the data driver 120, and supplies the aligned video data to the data driver 120. In the enable period of the second selection signal (CS2) input from the synchronizing signal detecting unit 144, the video data processing unit 143 aligns the same video data as that of the final frame stored in the frame memory 142, i.e., of the previous frame, and supplies the aligned data to the data driver 120. The video data processing unit 143 uses the dot clock signal (DCLK) or the internal clock signal (ICLK) from the synchronizing signal selecting unit 145 so as to input the video data.

Figure 4:
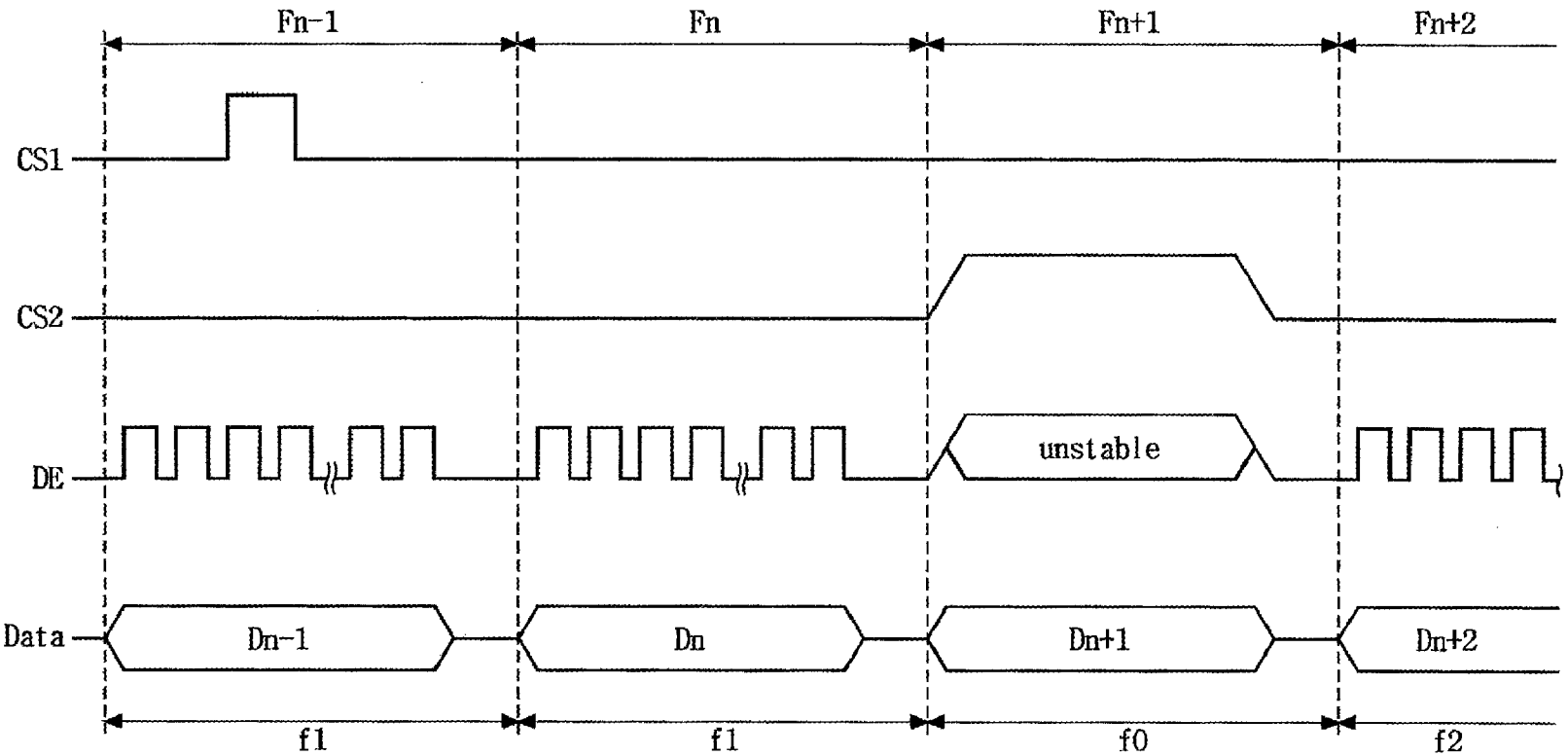
FIG. 4 illustrates exemplary input/output waveforms of the timing controller shown in FIG. 3 according to the present invention.

FIG. 4 illustrates input/output waveforms of the timing controller shown in FIG. 3. In particular, FIG. 4 shows the first selection signal (CS1) that predicts the conversion of frame frequency, the second selection signal (CS2) that indicates the period where the frame frequency is converted, the data enable signal (DE) that indicates the effective period of video data per one horizontal period, and the video data output from the timing controller 140.

The first selection signal (CS1) is generated in the (n−1)th frame (Fn−1) driven by the first frame frequency (f1) from the graphic system 150. By the timing controller 140, the video data of the (n)th frame (Fn), i.e., the final frame driven by the first frame frequency (f1), is stored in the frame memory 142 in response to the first selection signal (CS1). The video data of the (n)th frame (Fn) stored in the frame memory 142 is maintained up to the (n+1)th frame (Fn+1).

If the unstable period of the data enable signal (DE) is detected in the synchronizing signals during the process of converting the first frame frequency (f1) to the second frame frequency (f2) in the graphic system 150, the timing controller 140 generates the enabled second control signal (CS2). In the enable period of the second control signal (CS2), i.e., the (n+1)th frame (Fn+1), the timing controller 140 supplies the video data of the previous frame (Fn) stored in the frame memory 142 to the data driver 120. At this time, the timing controller 140 generates the control signals (DCS, GCS) suitable for the standard frame frequency (f0) by using the internal clock signal (ICLK), to thereby control the data driver 120 and the gate driver 130.

In this case, the enable period (Fn+1) of the second control signal (CS2), where the frame frequency is converted, is delayed more than the first selection signal (CS1) that predicts the conversion of frequency, so as to obtain the time required for preparing the video data supplied to the liquid crystal display part 110 during the process of converting the frequency in the timing controller 140. The delay time mentioned above can be controlled depending on specific design requirements by the designer. Also, the enable period of the second control signal (CS2) may include at least one to several frames.

The timing controller 140 again disables the second selection signal (CS2) when the stable synchronizing signal is supplied after the conversion to the second frame frequency (f2) in the graphic system 150 is completed. In the disabled period of the second selection signal (CS2), i.e., the (n+2)th frame (Fn+2), the timing controller 140 supplies the video data output from the graphic system 150 to the data driver 120. Also, the timing controller 140 generates the control signals (DCS, GCS) for controlling the data drivers 120 and gate drivers 130 by using the synchronizing signals which are converted to be appropriate for the second frame frequency (f2).

As a result, the liquid crystal display part 110 is driven by the first frame frequency (f1) to the frame (Fn) immediately before the first frame frequency (f1) is converted into the second frame frequency (f2), to thereby display the image. In the frame (Fn+1) of the process for converting the first frame frequency (f1) to the second frame frequency (f2), the liquid crystal display part 110 is driven by the standard frame frequency (f0) of the timing controller 140, and is displayed with the image of the previous frame (Fn), i.e., the final frame of the first frame frequency (f1). From the frame (Fn+2) in which the conversion from the first frame frequency (f1) to the second frame frequency (f2) is completed, the liquid crystal display part 110 is driven by the second frame frequency (f2), to thereby display the image.

In the above apparatus for driving the LCD device according to the present invention, the liquid crystal display part 110 is driven using the internal clock signal and the video data of the previous frame on the process of converting the frequency in response to the first selection signal (CS1) of the graphic system 150, thereby preventing any error of the timing controller 140 and defective images.

Figure 5:
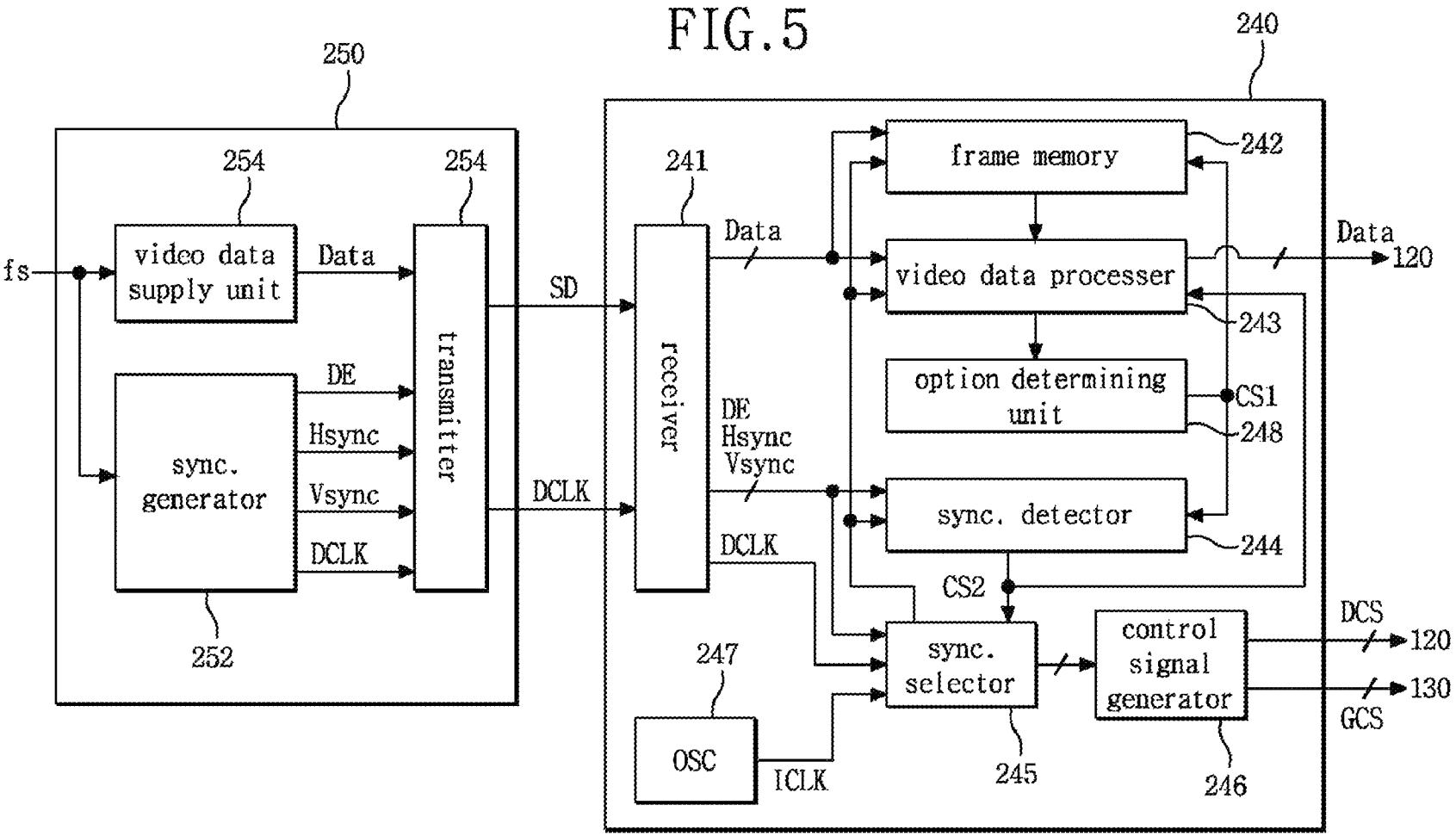
FIG. 5 illustrates a graphic system and a timing controller according to the second exemplary embodiment of the present invention.

FIG. 5 illustrates a graphic system and a timing controller according to the second exemplary embodiment of the present invention. In FIG. 5, the portions that are identical to those in FIG. 3 will be explained in brief. As shown in FIG. 5, the graphic system 250 includes a video data supplying unit 251, a synchronizing signal generating unit 252, and a data transmitting unit 254.

The video data supplying unit 251 aligns the video data input from the exterior in accordance with the EDID, and supplies the aligned data to the data transmitting unit 254. Also, when the frequency conversion signal (fs) is input externally, the video data supplying unit 251 generates and outputs option data which can predict the conversion of frequency and a flag which indicates whether or not the option data exists. The flag and option data are inserted into a blank period in which the video data is not supplied and are supplied to the data transmitting unit 254.

The synchronizing signal generating unit 252 generates a plurality of synchronizing signals (DCLK, Hsync, Vsync, DE) in accordance with the EDID, and supplies the generated synchronizing signals to the data transmitting unit 254. Also, when the frequency conversion signal (fs) is input externally, the synchronizing signal generating unit 152 converts the frequency of the synchronizing signals (DCLK, Hsync, Vsync, DE) to be appropriate for the frame frequency selected in the EDID, and outputs the synchronizing signals having the converted frequency to the data transmitting unit 254.

The data transmitting unit 254 compresses the video data, the flag, and the option data which are generated in the video data supplying unit 251, and the synchronizing signals (Hsync, Vsync, DE) which are generated in the synchronizing signal generating unit 252 into serial data (SD). Then, the data transmitting unit 254 supplies the serial data (SD) to the timing controller 240 and supplies the dot clock signal (DCLK) without being compressed to the timing controller 240.

As shown in FIG. 5, the timing controller 240 includes a data receiving unit 241, a frame memory 242, a video data processing unit 243, a synchronizing signal detecting unit 244, a synchronizing signal selecting unit 245, a control signal generating unit 246, an oscillator (OSC) 247, and an option determining unit 248.

The data receiving unit 241 restores the serial data (SD) output from the graphic system 250 to the video data and the synchronizing signals (DE, Hsync, Vsync). The data receiving unit 241 then outputs the restored video data and synchronizing signals in parallel, and further outputs the dot clock signal (DCLK) without being restored. As shown in FIG. 4, the option determining unit 248 generates a first selection signal (CS1) when the option data for predicting the frequency conversion is input through the video data processing unit 243 from the data receiving unit 241. When the first selection signal (CS1) is input to the synchronizing signal detecting unit 244 from the option determining unit 248, the synchronizing signal detecting unit 244 examines at least one of the synchronizing signals (DE, Hsync, Vsync, DCLK) output from the data receiving unit 241, to thereby detect the unstable period thereof. Then, the synchronizing signal detecting unit 244 generates a second selection signal (CS2) that indicates the frequency conversion period. At this time, the synchronizing signal detecting unit 244 counts the number of data enable signals (DE) by using the dot clock signal (DCLK) or the internal clock signal (ICLK). If the counted number is outside the reference range, it is referred to as an unstable period, thereby generating the second selection signal (CS2).

The synchronizing signal selecting unit 245 supplies the synchronizing signals (De, Hsync, Vsync, DCLK) output from the data receiving unit 241 to the control signal generating unit 246 during the disable period of the second selection signal (CS2) in the synchronizing signal detecting unit 244. In the enable period of the second selection signal (CS2), where the synchronizing signal is in the unstable period on the process of converting the frequency, the synchronizing signal selecting unit 245 supplies the internal clock signal (ICLK) output from the OSC 247 to the control signal generating unit 246. The dot clock signal (DCLK) or the internal clock signal (ICLK) selected by the synchronizing signal selecting unit 245 is supplied to the frame memory, the video data processing unit 243, and the synchronizing signal detecting unit 244.

In the stable period of the synchronizing signal, the control signal generating unit 246 generates the data control signal (DCS) and the gate control signal (GCS) by using the synchronizing signals (DE, Hsync, Vsync, DCLK) output from the synchronizing signal selecting unit 245. In the unstable period of the synchronizing signal, the control signal generating unit 246 generates the data control signal (DCS) and the gate control signal (GCS) by using the internal clock signal (ICLK) from the synchronizing signal selecting unit 245.

When the first selection signal (CS1) output from the option determining unit 248 is input, the frame memory 242 stores the video data of the final frame from the data receiving unit 241. Then, it supplies the video data of the previous frame, i.e., the final frame stored in the enable period of the second selection signal (CS2) from the synchronizing signal detecting unit 244, to the video data processing unit 243. The frame memory 242 uses the dot clock signal (DCLK) or the internal clock signal (ICLK) from the synchronizing signal selecting unit 245 so as to input or output the video data.

In the meantime, the frame memory 242 buffers the video data output from the data receiving unit 241 by frames, and supplies the buffered video data to the video data processing unit 243. In this case, if the first selection signal (CS1) is input, the video data of the final frame is input to the frame memory 242, and is then maintained without being updated. In the enable period of the second selection signal (CS2), the video data of the final frame (previous frame) stored in the frame memory 242 is supplied to the video data processing unit 243. Subsequently, if the second selection signal (CS2) is disabled with completion of the conversion of frequency, the frame memory 242 buffers the video data from the data receiving unit 241, and supplies the buffered video data to the video data processing unit 243.

Figure 6:
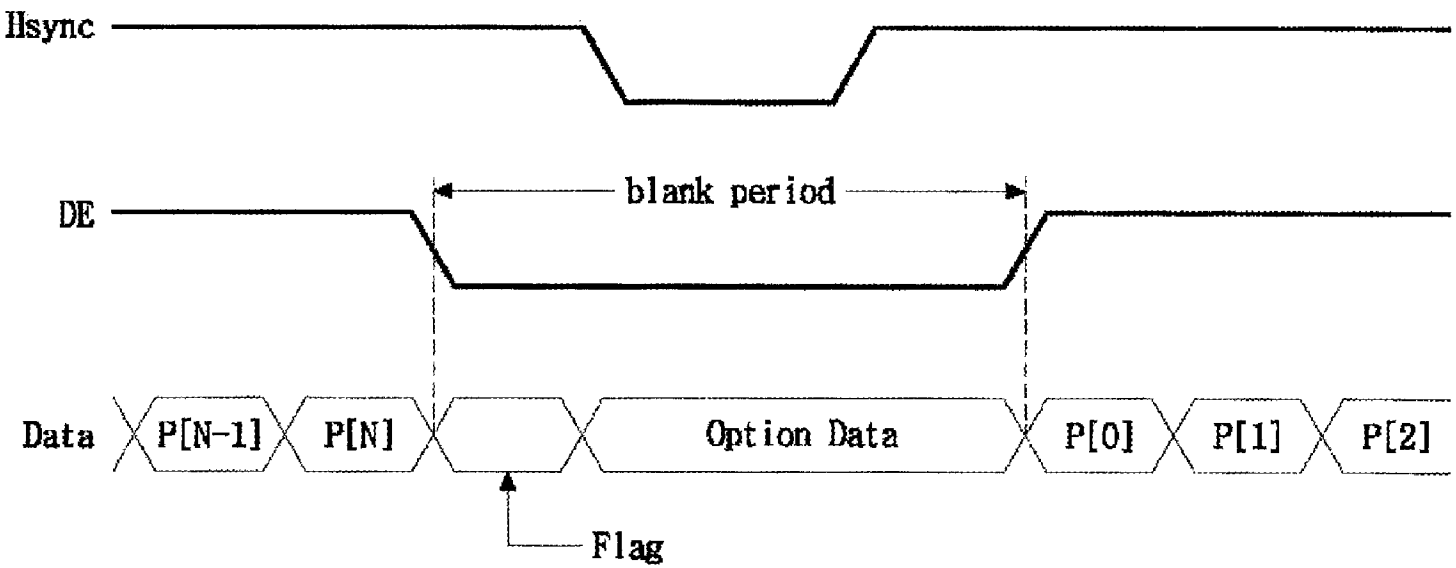
FIG. 6 illustrates exemplary input/output waveforms of the timing controller shown in FIG. 5 according to the present invention.

The video data processing unit 243 aligns the video data output from the data receiving unit 241 or the frame memory 242 to be appropriate for the data driver 120, and supplies the aligned data to the data driver 120. Also, if the input flag indicates that the option data is inserted into the video data output from the data receiving unit 241, the video data processing unit 243 divides the option data from the video data, and supplies the divided option data to the option determining unit 248. As shown in FIG. 6, the flag and the option data are inserted into the blank period of the data enable signal (DE) overlapping with the fore and rear parts of the horizontally synchronized signal (Hsync). In the enable period of the second selection signal (CS2) output from the synchronizing signal detecting unit 244, the video data processing unit 243 aligns the same video data as that of the previous frame, i.e., the final frame stored in the frame memory 242, and supplies the aligned data to the data driver 120. The video data processing unit 243 uses the dot clock signal (DCLK) or the internal clock signal (ICLK) from the synchronizing signal selecting unit 145 so as to input the video data. In the above apparatus for driving the LCD device according to the present invention, the liquid crystal display part 110 is driven using the internal clock signal and the video data of the previous frame on the process of converting the frequency in response to the option data output from the graphic system 250, thereby preventing error of the timing controller 240, and the defective image.

Figure 7:
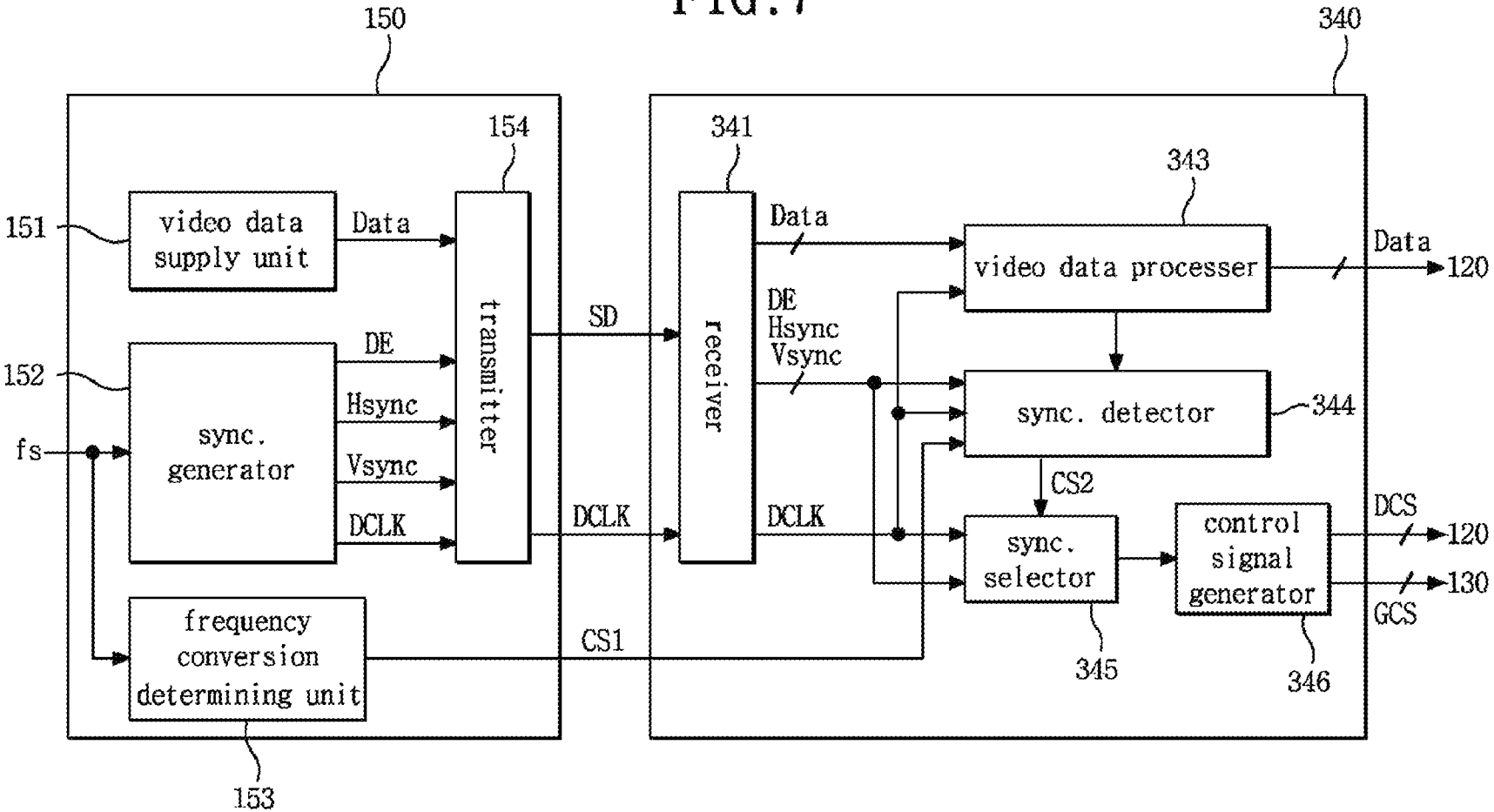
FIG. 7 illustrates a graphic system and a timing controller according to the third exemplary embodiment of the present invention.

FIG. 7 illustrates a graphic system and a timing controller according to the third exemplary embodiment of the present invention, wherein the graphic system 150 is identical in structure to that of FIG. 3. Therefore, the detailed explanation for the graphic system 150 will be omitted. The graphic system 150 of FIG. 7 includes a video data supplying unit 151 that supplies video data, a synchronizing signal generating unit 152 that supplies synchronizing signals (DCLK, Hsync, Vsync, DE) and converts frequency of the synchronizing signals in response to a frequency conversion signal (fs), a frequency conversion determining unit 153 that supplies a first selection signal (CS1) in response to the frequency conversion signal (fs), and a data transmitting unit 154 that compresses the video data and the synchronizing signals (Hsync, Vsync, DE) into serial data (SD) and outputs the serial data (SD). The timing controller 340 of FIG. 7 includes a data receiving unit 341, a video data processing unit 343, a synchronizing signal detecting unit 344, a synchronizing signal selecting unit 345, and a control signal generating unit 346.

The data receiving unit 341 restores the serial data (SD) output from the graphic system 150 to the video data and the synchronizing signals (DE, Hsync, Vsync). Then, the data receiving unit 341 outputs them in parallel, and outputs the dot clock signal (DCLK) without being restored.

The video data processing unit 343 aligns the video data output from the data receiving unit 341 to be appropriate for the data driver 120, and supplies the aligned video data to the data driver 120. The synchronizing signal detecting unit 344 examines at least one of the synchronizing signals (DE, Hsync, Vsync, DCLK) so as to detect the unstable period thereof, when a first selection signal (CS1) output from the graphic system 150 is input, thereby generating a second selection signal (CS2). In accordance with the second selection signal (CS2) output from the synchronizing signal detecting unit 344, the synchronizing signal selecting unit 345 may supply the synchronizing signals (DE, Hsync, Vsync, DCLK), or blocks at least one of the synchronizing signals. In the disable period of the second selection signal (CS2), the synchronizing signal selecting unit 345 supplies the synchronizing signals (DE, Hsync, Vsync, DCLK) output from the data receiving unit 341 to the control signal generating unit 346. In this case, the disable period of the second selection signal (CS2) refers to the period in which the synchronizing signals (DE, Hsync, Vsync, DCLK) are stably supplied. This period can be obtained when there is no conversion of frame frequency in the graphic system 150 or when the conversion of frame frequency is completed. In the enable period of the second selection signal (CS2), i.e., the period having the unstable synchronizing signal on the process of frequency conversion, the synchronizing signal selecting unit 345 blocks at least one of the synchronizing signals, for example, the input of dot clock signal (DCLK).

In the stable period of the synchronizing signal, the control signal generating unit 346 generates the data control signal (DCS) and the gate control signal (GCS) by using the synchronizing signals (DE, Hsync, Vsync, DCLK) output from the synchronizing signal selecting unit 345, and respectively supplies the generated data and gate control signals (DCS, GCS) to the data driver 120 and the gate driver 130. In the unstable period of the synchronizing signal, the data and gate control signals (DCS, GCS) are not generated in the control signal generating unit 346 since the synchronizing signal, i.e., the dot clock signal (DCLK) is not input through the synchronizing signal selecting unit 345. In the unstable period of the synchronizing signal, i.e., the period of converting the frequency in the graphic system 150, the control signal generating unit 346 controls the data and gate drivers 120 and 130 not to be driven. Accordingly, In the unstable period of the synchronizing signal, the liquid crystal display part 110 maintains the image of previous frame, which is charged when the data driver 120 and the gate driver is driven.

The apparatus for driving the LCD device according to the present invention, which responds to the first selection signal (CS1) output from the graphic system 150, maintains the image of the previous frame by not driving the data drivers 120 and gate drivers 130 during the conversion of the frame frequency, thereby preventing defective images.

Figure 8:
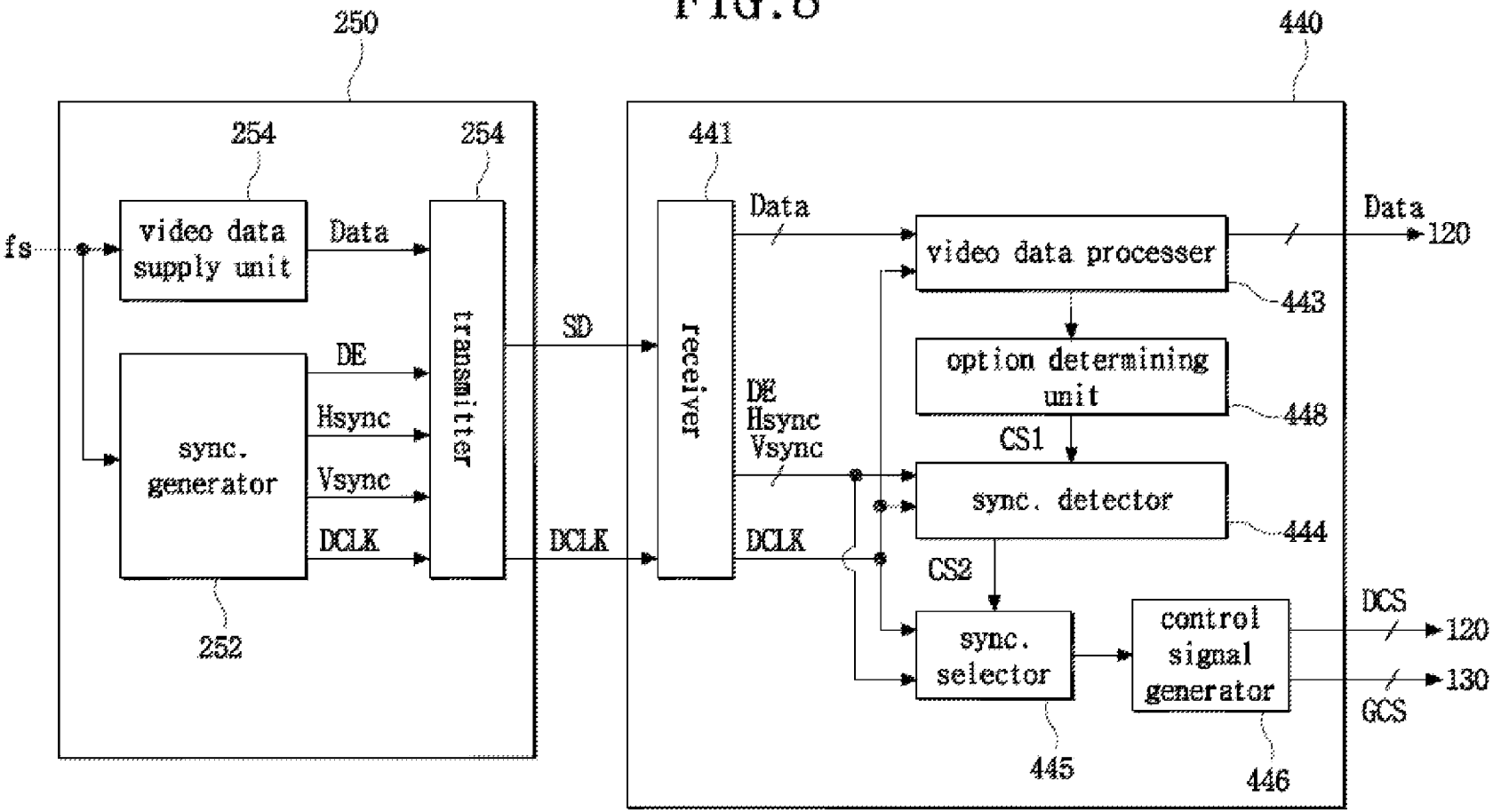
FIG. 8 illustrates a graphic system and a timing controller according to the fourth exemplary embodiment of the present invention.

FIG. 8 illustrates a graphic system and a timing controller according to the fourth exemplary embodiment of the present invention, wherein the graphic system 250 is identical in structure to that of FIG. 5. Therefore, the detailed explanation for the graphic system 250 will be omitted. The graphic system of FIG. 8 includes a video data supplying unit 251 that supplies video data, and generates and supplies a flag and option data in response to a frequency-conversion signal (fs), a synchronizing signal generating unit 252 that supplies synchronizing signals (DCLK, Hsync, Vsync, DE) and converts frequency of the synchronizing signals (DCLK, Hsync, Vsync, DE) in response to the frequency-conversion signal (fs), and a data transmitting unit 254 that compresses the video data, the flag, the option data, and the synchronizing signals to serial data (SD). As shown in FIG. 8, the timing controller 440 includes a data receiving unit 441, a video data processing unit 443, a synchronizing signal detecting unit 444, a synchronizing signal selecting unit 445, a control signal generating unit 446, and an option determining unit 448.

The data receiving unit 441 restores the serial data (SD) output from the graphic system 250 to the video data and the synchronizing signals (DE, Hsync, Vsync). The data receiving unit 441 outputs the restored data in parallel and further outputs the dot clock signal (DCLK) without being restored.

The video data processing unit 443 aligns the video data output from the data receiving unit 441 to be appropriate for the data driver 120, and supplies the aligned data to the data driver 120. Also, the video data processing unit 443 divides the option data from the video data and supplies the divided option data to the option determining unit 448 when the input flag indicates that the option data is inserted into the video data output from the data receiving unit 441. When the option data for predicting the frequency conversion is input from the video data processing unit 443, the option determining unit 448 generates a first selection signal (CS1).

When the first selection signal (CS1) is input from the option determining unit 448, the synchronizing signal detecting unit 444 examines at least one of the synchronizing signals (DE, Hsync, Vsync, DCLK) output from the data receiving unit 441, to thereby detect the unstable period thereof. Then, the synchronizing signal detecting unit 444 generates a second selection signal (CS2) that indicates the frequency conversion period. In accordance with the second selection signal (CS2) output from the synchronizing signal detecting unit 444, the synchronizing signal selecting unit 445 may supply the synchronizing signals (DE, Hsync, Vsync, DCLK) from the data receiving unit 441, or block at least one of the synchronizing signals. In the disable period of the second selection signal (CS2), the synchronizing signal selecting unit 445 supplies the synchronizing signals (DE, Hsync, Vsync, DCLK) output from the data receiving unit 441 to the control signal generating unit 446. In the enable period of the second selection signal (CS2), i.e., the period having the unstable synchronizing signal on the process of frequency conversion, the synchronizing signal selecting unit 445 blocks at least one of the synchronizing signals, for example, the input of dot clock signal (DCLK).

The control signal generating unit 446 generates the data and gate control signals (DCS, GCS) by using the synchronizing signals (DE, Hsync, Vsync, DCLK) output from the synchronizing signal selecting unit 445 in the stable period of the synchronizing signal, and respectively supplies the generated data and gate control signals (DCS, GCS) to the data drivers 120 and gate drivers 130. In the unstable period of the synchronizing signal, the data and gate control signals (DCS, GCS) are not generated in the control signal generating unit 446 since the synchronizing signal, i.e., the dot clock signal (DCLK), is not input through the synchronizing signal selecting unit 445. Accordingly, in the unstable period of the synchronizing signal, i.e., the period of converting the frequency in the graphic system 250, the control signal generating unit 446 helps the data drivers 120 and gate drivers 130 not to be driven.

The apparatus for driving the LCD device according to the present invention, which responds to the option data output from the graphic system 250, maintains the image of the previous frame by not driving the data drivers 120 and gate drivers 130 during the conversion of the frame frequency, thereby preventing defective images.

As mentioned above, the apparatus and method for driving the LCD device according to the present invention has the following advantages. In the apparatus and method for driving the LCD device according to the present invention, the liquid crystal display part is driven using the internal clock and the video data of previous frame during the process of converting the frame frequency in response to the frequency-conversion prediction information supplied from the graphic system before the frequency conversion, thereby preventing error in the timing controller and defective images. Furthermore, the apparatus for driving the LCD device according to the present invention, which responds to frequency-conversion prediction information supplied from the graphic system before the frequency conversion, maintains the image of the previous frame by not driving the data and gate drivers during the conversion of the frame frequency, thereby preventing defective images.

As a result, the apparatus and method for driving the LCD device according to the present invention can convert the frame frequency without generating defective image, to thereby decrease the power consumption.

It will be apparent to those skilled in the art that various modifications and variations can be made in the apparatus and method for driving liquid crystal display device of the present invention without departing from the spirit or scope of the invention. Thus, it is intended that the present invention cover the modifications and variations of this invention provided they come within the scope of the appended claims and their equivalents.

What is claimed is:

1. An apparatus for driving an LCD device, comprising:

a liquid crystal display part to display images;

a driver to drive the liquid crystal display part;

a graphic system to output video data and a plurality of synchronizing signals, output frequency-conversion prediction information in accordance with a frequency-conversion signal, and output frequency converted synchronizing signals; and a timing controller to control the driver by using the video data and synchronizing signals and to prevent the driver from being driven for a period of converting the frequency in response to the frequency-conversion prediction information, wherein the timing controller includes:

a synchronizing signal detecting unit to detect a frequency-conversion period from at least one of the synchronizing signals in response to a first selection signal relating the frequency-conversion prediction information and to output a second selection signal for indicating the frequency-conversion period;

a control signal generating unit to generate a plurality of control signals to control the driver by using the synchronizing signals;

a synchronizing signal selecting unit to output the synchronizing signals to the control signal generating unit or to block the synchronizing signals in response to the second selection signal; and a video data processing unit to align the video data from the graphic system and output the aligned video data to the driver.

2. The apparatus of claim 1, wherein the graphic system includes:

a video data supplying unit to output the video data;

a synchronizing signal generating unit to output the plurality of synchronizing signals, and convert the frequency of the synchronizing signals in response to the frequency-conversion signal; and a frequency-conversion determining unit to generate and output the first selection signal relating the frequency-conversion prediction information in response to the frequency-conversion signal.

3. The apparatus of claim 1, wherein the synchronizing signal detecting unit detects an unstable period of at least one synchronizing signal and enables the second selection signal.

4. The apparatus of claim 3, wherein the synchronizing signal detecting unit counts data enable signals from the synchronizing signals in accordance with a dot clock to detect an unstable period of the data enable signals.

5. The apparatus of claim 1, wherein the liquid crystal display part maintains and displays the image of previous frame on converting the frequency.

* * * * *